US007264658B1

(12) United States Patent
Heckel et al.

(10) Patent No.: US 7,264,658 B1
(45) Date of Patent: Sep. 4, 2007

(54) ELECTROSTATIC PRECIPITATOR ELIMINATING CONTAMINATION OF GROUND ELECTRODE

(75) Inventors: Scott P. Heckel, Stoughton, WI (US); Gregory W. Hoverson, Cookeville, TN (US); Ananth Kuchimanchi, Stoughton, WI (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 11/436,829

(22) Filed: May 18, 2006

Related U.S. Application Data

(63) Continuation-in-part of application No. 10/824,317, filed on Apr. 8, 2004, now Pat. No. 7,112,236.

(51) Int. Cl.
*B03C 3/36* (2006.01)

(52) U.S. Cl. ..... 96/62; 96/64; 96/77; 96/97

(58) Field of Classification Search ..... 96/77–79, 96/97, 60, 62, 64
See application file for complete search history.

(56) References Cited

U.S. PATENT DOCUMENTS

| | | | | |
|---|---|---|---|---|
| 1,605,648 | A | 11/1926 | Cooke | |
| 2,085,349 | A | 6/1937 | Wintermute | |
| 2,114,682 | A | 4/1938 | Gumaer | |
| 2,142,128 | A | 9/1939 | Hoss et al. | |
| 3,569,751 | A | 3/1971 | Ruhnke | |
| 3,668,835 | A | 6/1972 | Vicard | |
| 3,755,991 | A | 9/1973 | Steuernagel | |
| 3,910,779 | A | 10/1975 | Penney | |
| 3,985,524 | A | 10/1976 | Masuda | |
| 3,999,964 | A | 12/1976 | Carr | |
| 4,202,674 | A | 5/1980 | Rodenberger et al. | |
| 4,222,748 | A | 9/1980 | Argo et al. | |
| 4,231,766 | A * | 11/1980 | Spurgin | 96/79 |
| 4,239,514 | A | 12/1980 | Junkers | |
| 4,251,234 | A * | 2/1981 | Chang | 95/78 |
| 4,339,782 | A * | 7/1982 | Yu et al. | 96/62 |
| 4,381,927 | A | 5/1983 | Noll | |
| 4,478,613 | A | 10/1984 | Brettschneider et al. | |
| 4,673,416 | A * | 6/1987 | Sakakibara et al. | 96/79 |
| 4,713,092 | A | 12/1987 | Kikuchi et al. | |
| 5,911,213 | A | 6/1999 | Ahlborn et al. | |
| 5,922,111 | A | 7/1999 | Omi et al. | |
| 5,934,261 | A | 8/1999 | Schumann et al. | |
| 6,090,189 | A * | 7/2000 | Wikstrom et al. | 96/69 |
| 6,152,988 | A | 11/2000 | Plaks et al. | |

(Continued)

FOREIGN PATENT DOCUMENTS

| | | |
|---|---|---|
| DE | 307656 | 10/1919 |

(Continued)

OTHER PUBLICATIONS

*Mechanical Design considerations for dry precipitators*, Applied Electrostatic Precipitation, F. Knuttsen and K. R. Parker, Dec. 1997, pp. 89-112.

(Continued)

*Primary Examiner*—Richard L. Chiesa
(74) *Attorney, Agent, or Firm*—Andrus, Sceales,Starke & Sawall, LLP; J. Bruce Schelkopf

(57) ABSTRACT

An electrostatic precipitator reduces contamination of the ground electrode by separating charging and collection stages.

9 Claims, 6 Drawing Sheets

U.S. PATENT DOCUMENTS

| | | | | |
|---|---|---|---|---|
| 6,221,136 | B1 | 4/2001 | Liu et al. | |
| 6,251,171 | B1 * | 6/2001 | Marra et al. | 96/69 |
| 6,287,368 | B1 | 9/2001 | Ilmasti | |
| 6,294,003 | B1 | 9/2001 | Ray | |
| 6,312,507 | B1 * | 11/2001 | Taylor et al. | 96/19 |
| 6,348,103 | B1 | 2/2002 | Ahlborn et al. | |
| 6,364,941 | B2 | 4/2002 | Liu et al. | |
| 6,506,238 | B1 * | 1/2003 | Endo | 96/79 |
| 6,524,369 | B1 | 2/2003 | Krigmont | |
| 6,527,821 | B2 | 3/2003 | Liu et al. | |
| 6,582,500 | B1 * | 6/2003 | Ohadi et al. | 96/61 |
| 6,635,106 | B2 * | 10/2003 | Katou et al. | 96/67 |
| 6,902,604 | B2 | 6/2005 | Heckel et al. | |
| 6,994,076 | B2 | 2/2006 | Heckel et al. | |
| 7,112,236 | B2 * | 9/2006 | Hoverson et al. | 95/78 |
| 2003/0131727 | A1 * | 7/2003 | Fissan et al. | 95/58 |
| 2003/0177901 | A1 | 9/2003 | Krigmont | |

FOREIGN PATENT DOCUMENTS

| | | |
|---|---|---|
| DE | 3702469 | 8/1988 |
| DE | 3930872 | 3/1991 |
| EP | 0 044 361 | 1/1982 |
| JP | 52-67074 | 6/1977 |
| JP | 53-2767 | 1/1978 |
| WO | WO-00/30755 | 6/2000 |

OTHER PUBLICATIONS

Applied Electrostatic Precipitation edited by K. R. Parker, 1997, pp. 1-8.

* cited by examiner

ELECTROSTATIC PRECIPITATOR ELIMINATING CONTAMINATION OF GROUND ELECTRODE

CROSS-REFERENCE TO RELATED APPLICATIONS

This application is a continuation-in-part of U.S. patent application Ser. No. 10/824,317, filed Apr. 8, 2004, now U.S. Pat. No. 7,112,236.

BACKGROUND AND SUMMARY

The invention relates to electrostatic precipitators or collectors, including for diesel engine electrostatic crankcase ventilation systems for blowby gas for removing suspended particulate matter including oil droplets from the blowby gas.

Electrostatic precipitators, including for diesel engine electrostatic crankcase ventilation systems, are known in the prior art. In its simplest form, a high voltage corona discharge electrode is placed in the center of a grounded tube or canister forming an annular ground plane providing a collector electrode around the discharge electrode. A high DC voltage, such as several thousand volts, e.g. 15 kV, on the center discharge electrode causes a corona discharge to develop near the electrode due to high electric field intensity. This electric field ionizes the gas in such corona discharge ionization zone, which in turn creates ions which in turn electrically charge suspended particles in the gas. The charged particles are in turn precipitated electrostatically onto the interior surface of the collecting tube or canister, i.e. attracted to such ground plane. Electrostatic collectors have been used in diesel engine crankcase ventilation systems for removing suspended particulate matter including oil droplets from the blowby gas, for example so that the blowby gas can be returned to the atmosphere, or to the fresh air intake side of the diesel engine for further combustion, thus providing a blowby gas recirculation system. The oil mist collects on the ground electrode provided by the canister, which collected oil mist is drained from the unit.

The present invention arose during continuing development efforts directed toward improved performance of an electrostatic precipitator, including reducing contamination of the ground electrode, including the noted oil mist collected on the annular ground plane canister in a diesel engine electrostatic crankcase ventilation system application.

BRIEF DESCRIPTION OF THE DRAWING

FIG. 1 is a perspective assembly view of a multistage space-efficient electrostatic collector in accordance with the noted '317 application.

FIG. 2 is an exploded perspective view of the collector of FIG. 1.

FIG. 3 is a sectional view of the collector of FIG. 1.

DETAILED DESCRIPTION

Parent Application

Figure 1:
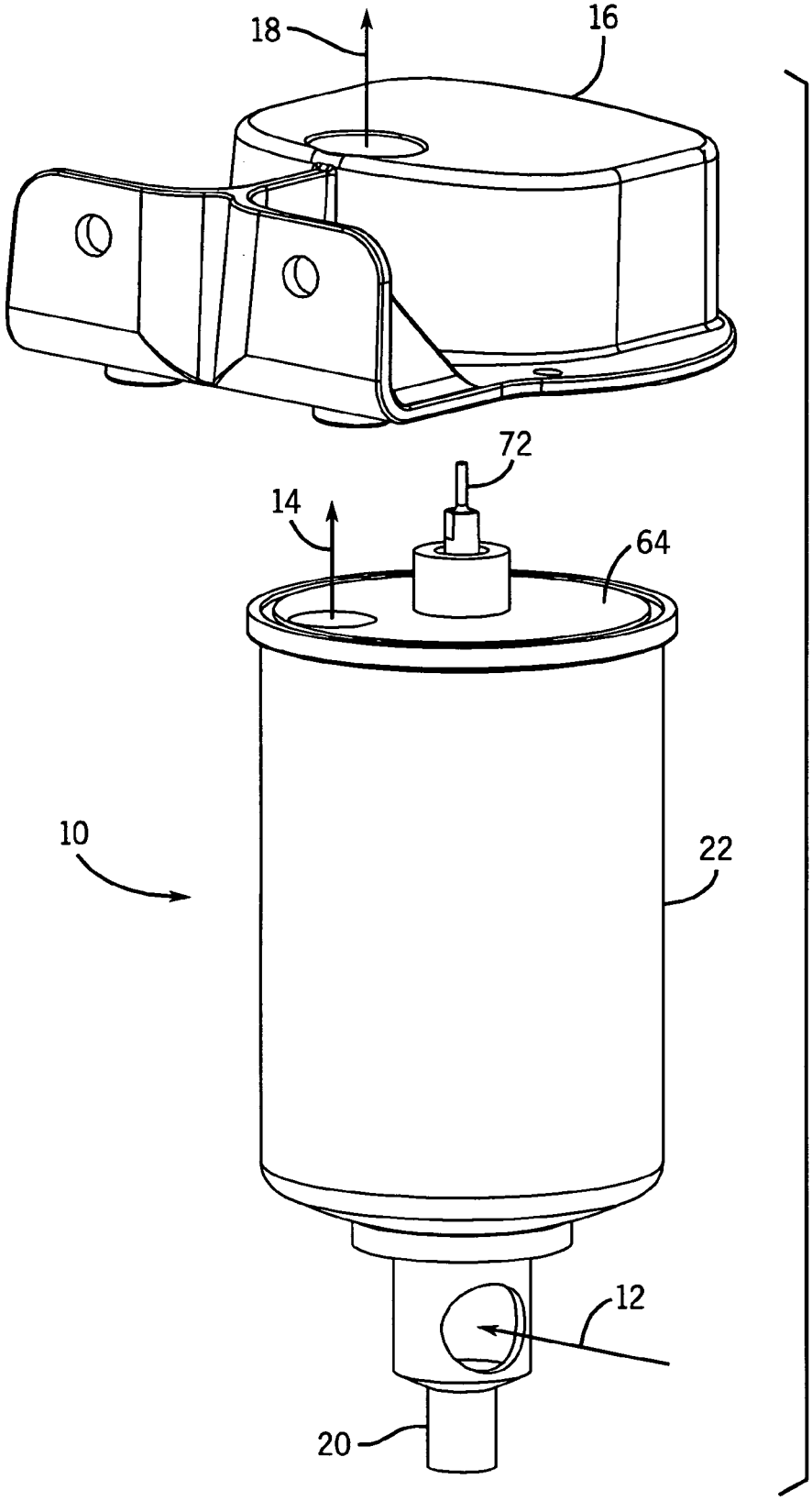
FIGS. 1-3 are taken from the noted parent '317 application.
Figure 2:
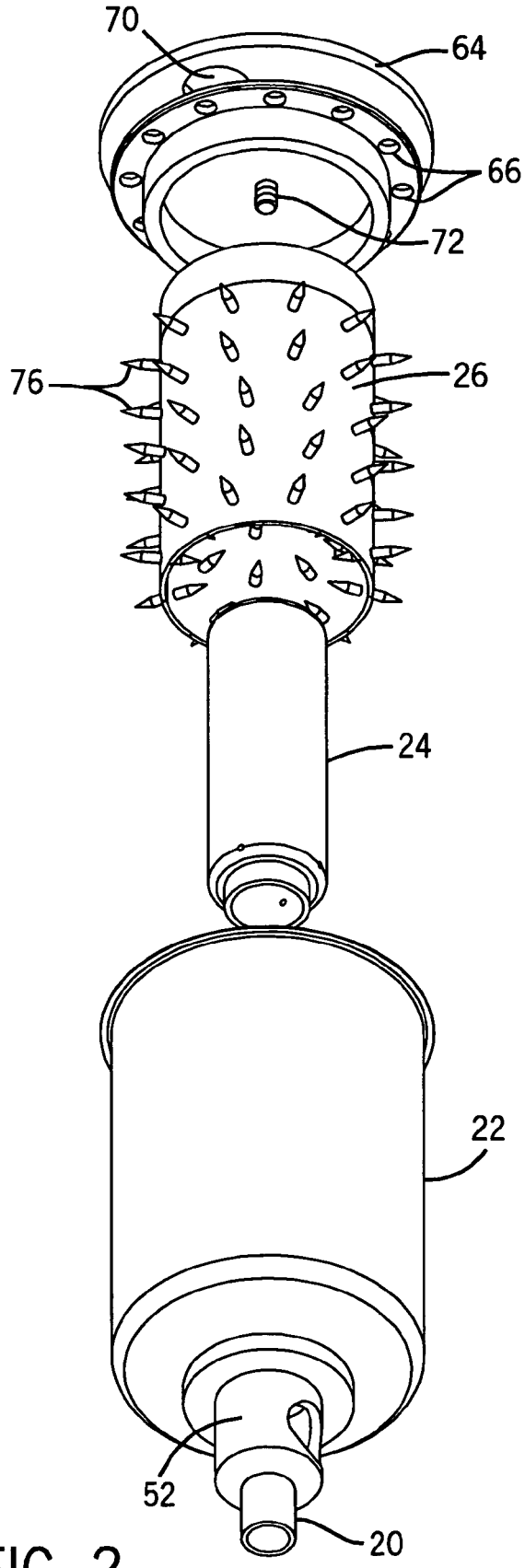
Figure 3:
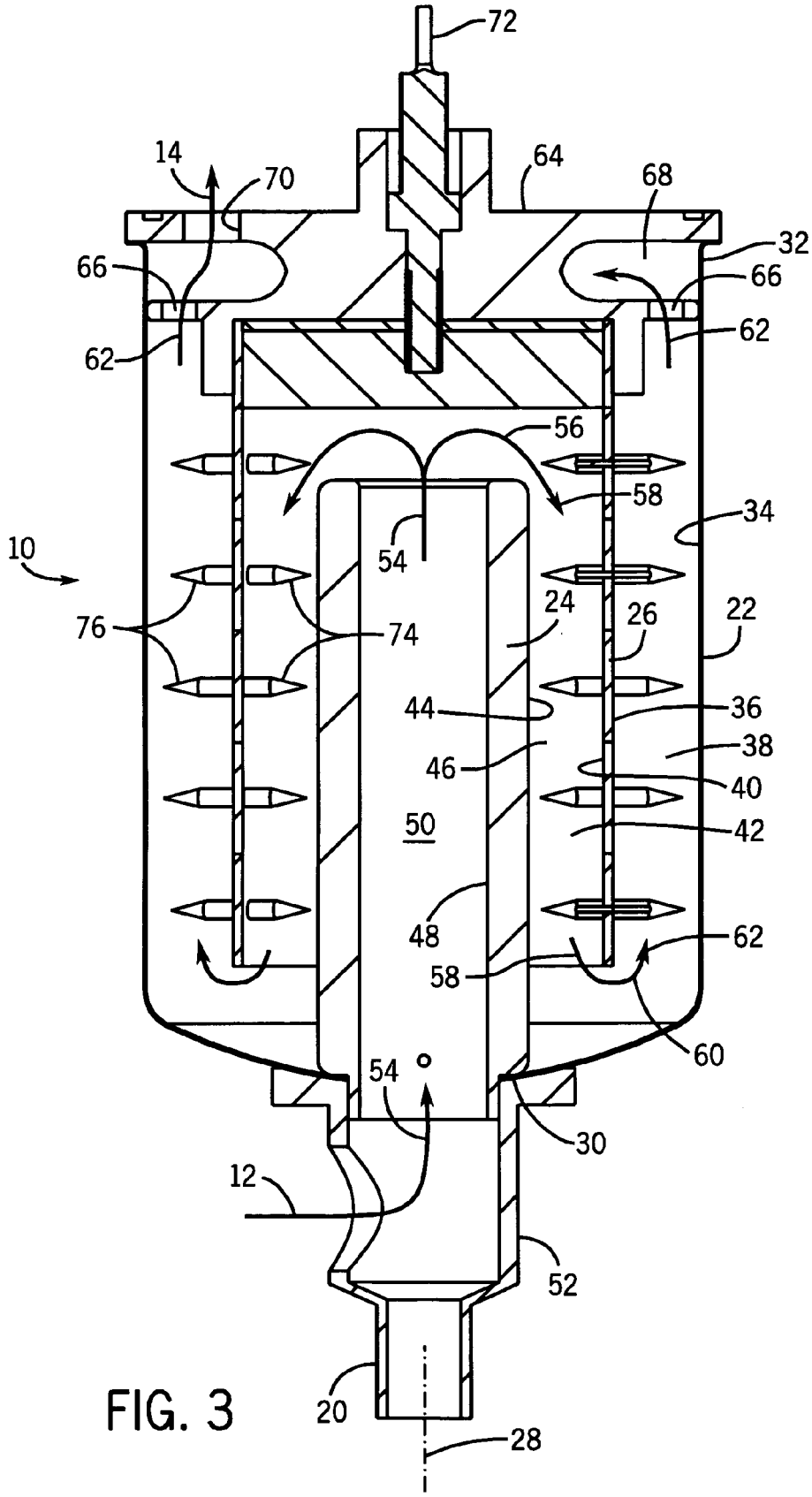

The following description of FIGS. 1-3 is taken from the noted parent '317 application.

FIG. 1 shows a multistage space-efficient electrostatic collector 10 for cleaning a gas flowing along a gas flow path as shown at arrows 12, 14. The collector is mountable to a mounting head 16, for example as shown in commonly owned co-pending U.S. patent application Ser. No. 10/820,541, filed on Apr. 8, 2004, now U.S. Pat. No. 6,994,076, which head is mounted to an internal combustion engine, such as a diesel engine, or in the engine compartment. Particulate matter, including oil droplets from blowby gas in the case of diesel engine exhaust, flows into the collector at arrow 12 and exits at arrows 14, 18 for return to the engine or for venting to the atmosphere. Collected particulate matter including oil droplets are periodically discharged through valved outlet 20, as is known.

The collector includes an outer ground plane canister 22, FIGS. 1-3, an inner ground plane tube 24, and a corona discharge electrode 26 therebetween. Canister 22 is a cylindrical member extending axially along an axis 28, FIG. 3, between an inlet end 30 and an outlet end 32 and having an inwardly facing inner wall 34 providing a collector electrode. Corona discharge electrode 26 in the canister is provided by a hollow drum extending axially along axis 28 and having an outer wall 36 facing inner wall 34 of the canister and defining an outer annular flow passage 38 therebetween. The drum has an inner wall 40 defining a hollow interior 42. The inner ground plane 24 is provided by a hollow tubular post extending from inlet end 30 of the canister axially into the canister and axially into hollow interior 42 of drum 26. Post 24 has an outer wall 44 facing inner wall 40 of drum 26 and defining an inner annular flow passage 46 therebetween. Outer wall 44 of post 24 provides a collector electrode. The post has an inner wall 48 defining a hollow interior 50 providing an initial flow passage.

Gas to be cleaned enters inlet fitting 52 as shown at arrow 12 and flows in a first axial direction upwardly as shown at arrow 54 along a first flow path segment through the noted initial flow passage along hollow interior 50 of post 24, then turns as shown at arrow 56 and flows in a second opposite axial direction 58 along a second flow path segment through the noted inner annular passage 46 along outer wall 44 of post 24 and inner wall 40 of drum 26, and then turns as shown at arrow 60 and flows in the noted first axial direction upwardly as shown at arrow 62 along a third flow path segment through outer annular passage 38 along outer wall 36 of drum 26 and inner wall 34 of canister 22. The canister is closed at its top by an electrically insulating disk 64 having a plurality of circumferentially spaced apertures 66 providing exit flow of the gas therethrough into plenum 68 and then to outlet port 70 for exit flow as shown at arrow 14. A high voltage electrode 72 extends through disk 64 and is electrically connected to drum 26.

In the preferred embodiment, the drum has a plurality of corona discharge elements provided by a plurality of inner discharge tips 74 protruding radially inwardly into inner annular flow passage 46 toward outer wall 44 of post 24 such that inner discharge tips 74 protrude into the noted second flow path segment 58, and/or provided by a plurality of outer discharge tips 76 protruding radially outwardly into outer annular flow passage 38 toward inner wall 34 of canister 22 such that outer discharge tips 76 protrude into the noted third flow path segment 62, which discharge tips may be like those shown in commonly owned co-pending U.S. patent application Ser. No. 10/634,565, filed Aug. 5, 2003, now abandoned. Drum 26 may be a metal or other conductive member, or may be an insulator and have conductor segments therealong connected to respective tips. Outer annular flow passage 38 is concentric to and radially outward of inner annular flow passage 46. Inner annular flow passage 46 is concentric to and radially outward of initial flow passage 50. The gas flows in a serpentine path through canister 22, including a first U-shaped bend 56 between first and second flow path segments 54 and 58, and a second U-shaped bend 60 between second and third flow path segments 58 and 62.

The disclosed construction provides a multistage space-efficient electrostatic collector for cleaning the gas flowing therethrough along a gas path and includes a first stage provided by a first corona discharge zone 46 along the gas flow path, and a second stage provided by a second corona discharge zone 38 along the gas flow path and spaced along the gas flow path from the first corona discharge zone 46. The electrostatic collector is provided by a corona discharge electrode 26 and two ground planes 24 and 22. The first corona discharge zone 46 is between corona discharge electrode 26 and first ground plane 24. The second corona discharge zone 38 is between corona discharge electrode 26 and second ground plane 22. The second ground plane is provided by the noted canister 22 extending axially along axis 28. The corona discharge electrode is provided by the noted hollow drum 26 in the canister and extending axially along axis 28. The first corona discharge zone 46 is inside the drum. The second corona discharge zone 38 is outside the drum. The noted first ground plane 24 is inside the drum. Each of the corona discharge electrode 26 and the second ground plane 22 is annular, and each of the noted first and second corona discharge zones 46 and 38 is an annulus. Ground plane 22 and corona discharge zone 38 and corona discharge electrode 26 and corona discharge zone 46 are concentric. Corona discharge zone 46 concentrically surrounds ground plane 24. Corona discharge electrode 26 concentrically surrounds corona discharge zone 46. Corona discharge zone 38 concentrically surrounds corona discharge electrode 26. Ground plane 22 concentrically surrounds corona discharge zone 38. Ground plane 24 is annular and defines initial gas flow zone 50 therethrough along the gas flow path at 54 and is spaced along the gas flow path from first and second corona discharge zones 46 and 38. Ground plane 24 concentrically surrounds initial gas flow zone 50. Gas flow along the gas flow path changes direction at 60 between the first and second corona discharge zones 46 and 38. Preferably, the change of direction is 180°. Gas flow along the gas flow path flows in a flow direction 58 along first corona discharge zone 46 and then reverses direction at 60 and flows in another flow direction 62 along second corona discharge zone 38. The first and second corona discharge zones 46 and 38 are concentric to each other. Flow direction 62 is parallel and opposite to flow direction 58. Second corona discharge zone 38 surrounds first corona discharge zone 46. The gas flow path has an initial gas flow zone at 50 directing gas flow therethrough prior to gas flow through first corona discharge zone 46. The initial gas flow zone 50 is a non-corona-discharge zone. The gas flow path is a serpentine path including initial gas flow zone 50, first corona discharge zone 46, and second corona discharge zone 38. The gas flow path has a first flow reversal zone at 56 between initial gas flow zone 50 and first corona discharge zone 46, and a second flow reversal zone at 60 between first corona discharge zone 46 and second corona discharge zone 38. Gas flows in a flow direction 54 along initial gas flow zone 50, then reverses at 56 and flows in flow direction 58 along first corona discharge zone 46, then reverses at 60 and flows in flow direction 62 along second corona discharge zone 38. Flow direction 58 is parallel and opposite to flow directions 54 and 62. Initial gas flow zone 50 and first corona discharge zone 46 and second corona discharge zone 38 are concentric. Second corona discharge zone 38 surrounds first corona discharge zone 46, and first corona discharge zone 46 surrounds initial gas flow zone 50.

The parent application provides a method for increasing residence time within the corona discharge zone of gas flowing through an electrostatic collector, provided by directing gas flow along a first corona discharge path 58 through zone 46 and then directing gas flow along a second corona discharge path 62 through zone 38. In the preferred method, the gas flow is directed along an initial flow path 54 through zone 50 in the electrostatic collector prior to directing gas flow along the first corona discharge path 58.

Present Application

Figure 4:
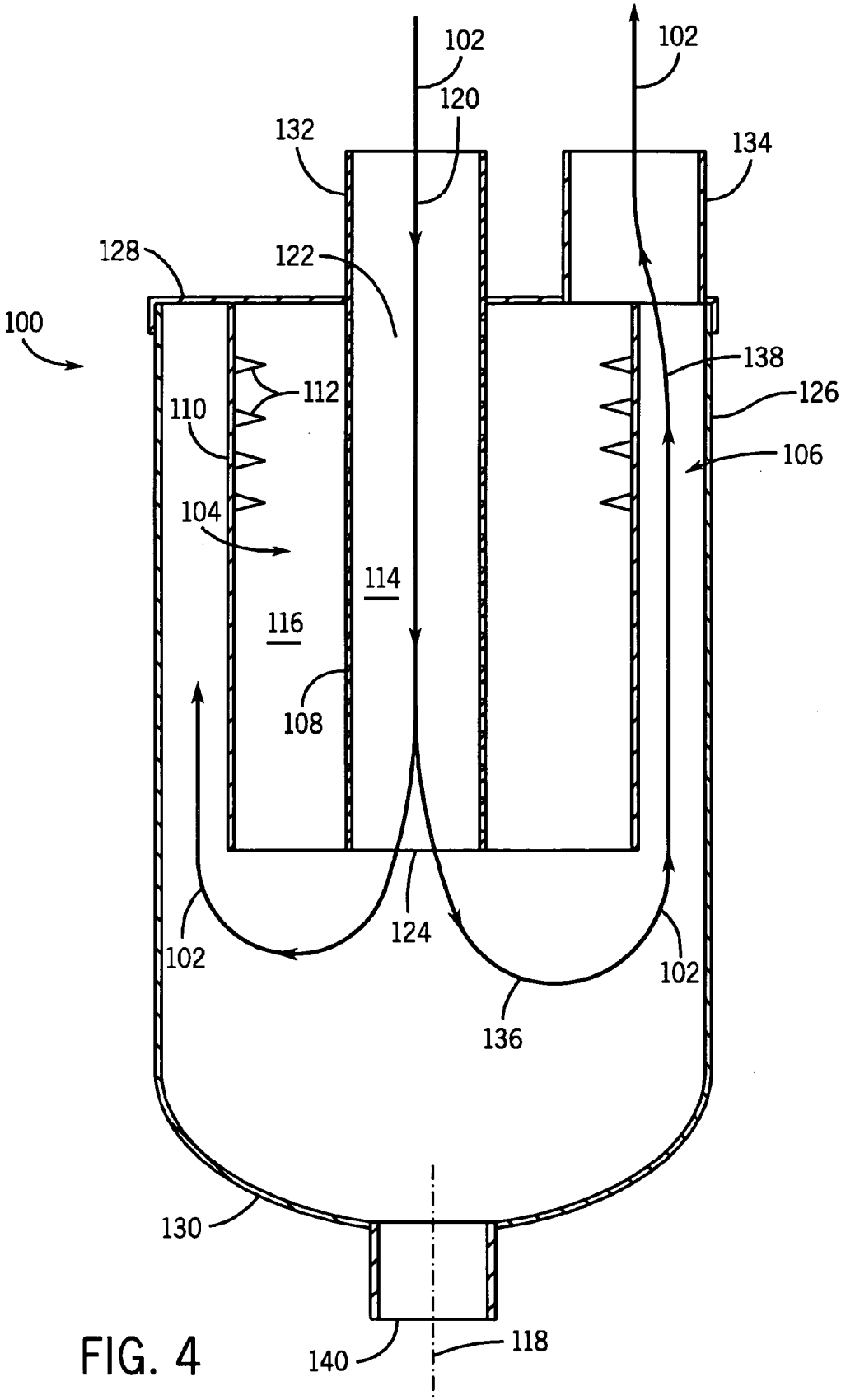
FIG. 4 is a sectional view of an electrostatic precipitator in accordance with the present application.

FIG. 4 shows an electrostatic precipitator 100 for cleaning a gas flowing therethrough from upstream to downstream along a gas flow path 102 including a first zone 104 providing a corona discharge ionization zone creating ions which in turn charge particles in the gas, and a second zone 106 providing a collection zone collecting the charged particles. Second zone 106 is downstream of first zone 104. Second zone 106 is spaced and separated from first zone 104 to functionally separate ionization and collection stages of the electrostatic precipitator into separate functions. The charged particles are dominantly collected in zone 106 and not in zone 104.

An anti-collector guide 108 is provided in first zone 104 for preventing collection of charged particles thereat, and instead directing the charged particles to flow to second zone 106 downstream thereof for collection at zone 106. A corona discharge electrode 110 is provided at first zone 104, and may include discharge tips 112, creating an electric field providing the corona discharge ionization. The anti-collector guide 108 is provided by a field-shield in zone 104, shielding the charged particles from the electric field, to prevent collection of such charged particles in zone 104. Field-shield 108 divides zone 104 into first and second subzones 114 and 116. First subzone 114 is on one side of field-shield 108 and guides the charged particles to zone 106. Second subzone 116 is on the opposite side of field-shield 108 and is between corona discharge electrode 110 and field-shield 108 and provides the noted ionization. The first subzone 114, the second subzone 116, and the second zone 106 functionally separate ionization, charging, and collection stages, respectively, of the electrostatic precipitator into separate functions.

In preferred form, field-shield 108 is a perforated tube, e.g. a screen or other type of tube, extending axially along axis 118, and guiding incoming gas at 120 from an inlet axial tube end 122 to an axially distally opposite outlet axial tube end 124. Corona discharge electrode 110 is preferably an axially extending hollow drum surrounding tube 108. The noted first subzone 114 is inside tube 108. The noted second subzone 116 is outside tube 108 and between tube 108 and drum 110. The ions created by ionization in subzone 116 pass through the perforations in tube 108 to create charged particles in subzone 114 inside tube 108. The charged particles are shielded by tube 108 from the electric field in subzone 116 outside tube 108 created by corona discharge electrode 110. Tube 108 is at ground potential.

An outer ground plane 126 surrounds drum 110. Second zone 106 is outside of and surrounds drum 110 and is between drum 110 and outer ground plane 126. Outer ground plane 126 is provided by a canister extending axially along axis 118 between first and second axial ends 128 and 130. First axial end 128 has both a gas inlet 132 and a cleaned gas outlet 134. Gas inlet 132 is at inlet axial tube end 122. Cleaned gas outlet 134 receives cleaned gas from zone 106. Gas flows from gas inlet 132 in a first axial direction as shown at arrow 120 through the noted first zone through the inside of tube 108 to outlet axial tube end 124, then flows radially outwardly as shown at arrow 136 to second zone 106, then flows in a second opposite axial direction as shown at arrow 138 to cleaned gas outlet 134. The charged particles are collected in zone 106 by their attraction to ground plane 126, from which such contaminant is drained from the canister at lower drain 140.

Figure 5:
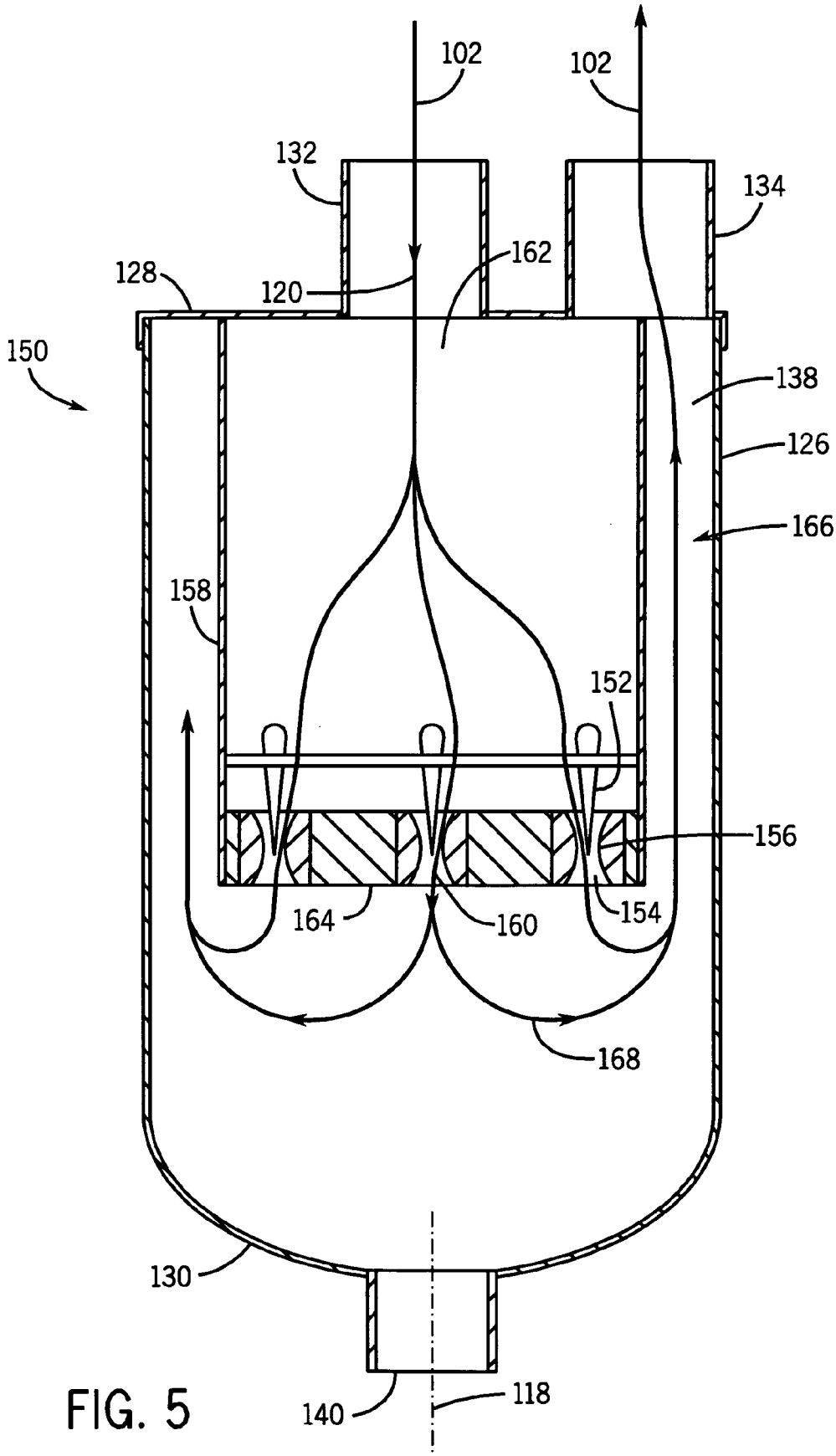
FIG. 5 is a view like FIG. 4 and shows another embodiment.

FIG. 5 shows another embodiment and uses like reference numerals from above where appropriate to facilitate understanding. Electrostatic precipitator 150 has a corona discharge electrode provided by one or more discharge tips such as 152 each at a respective first zone such as 154 creating an electric field providing corona discharge ionization. The above noted anti-collector guide is provided by one or more venturis such as 156 in the respective first zone 154 accelerating the charged particles to prevent collection thereof in zone 154. Each of the one or more corona discharge tips is disposed in a respective one of the venturis and provides ionization in an ionization zone 154 in the respective venturi 156. A hollow drum 158 extends axially along axis 118 and defines and surrounds the first zone 154 therein, and the one or more venturis 156 accelerate the charged particles axially therethrough as shown at arrows such as 160. Drum 158 has an inlet axial drum end 162 receiving incoming gas as shown at arrow 120, and has an outlet axial drum end 164 communicating with second zone 166. The one or more venturis 156 are at outlet axial drum end 164. The one or more venturis 156 are at ground potential.

Outer ground plane 126 surrounds drum 158. Second zone 156 is outside of and surrounds drum 158 and is between drum 158 and outer ground plane 126. Outer ground plane 126 is provided by a canister extending axially along axis 118 between first and second axial ends 128 and 130. First axial end 128 has both the noted gas inlet 132 and the noted cleaned gas outlet 134. Gas flows from gas inlet 132 in a first axial direction as shown at arrow 120 through the inside of drum 158 and through the noted one or more first zones 154 through the one or more venturis 156, then flows radially outwardly as shown at arrows such as 168 to second zone 166, then flows in a second opposite axial direction as shown at arrow 138 through second zone 166 to cleaned gas outlet 134. The charged particles are collected in zone 166 by their attraction to ground plane 126, from which such contaminant is drained from the canister at lower drain 140.

Figure 6:
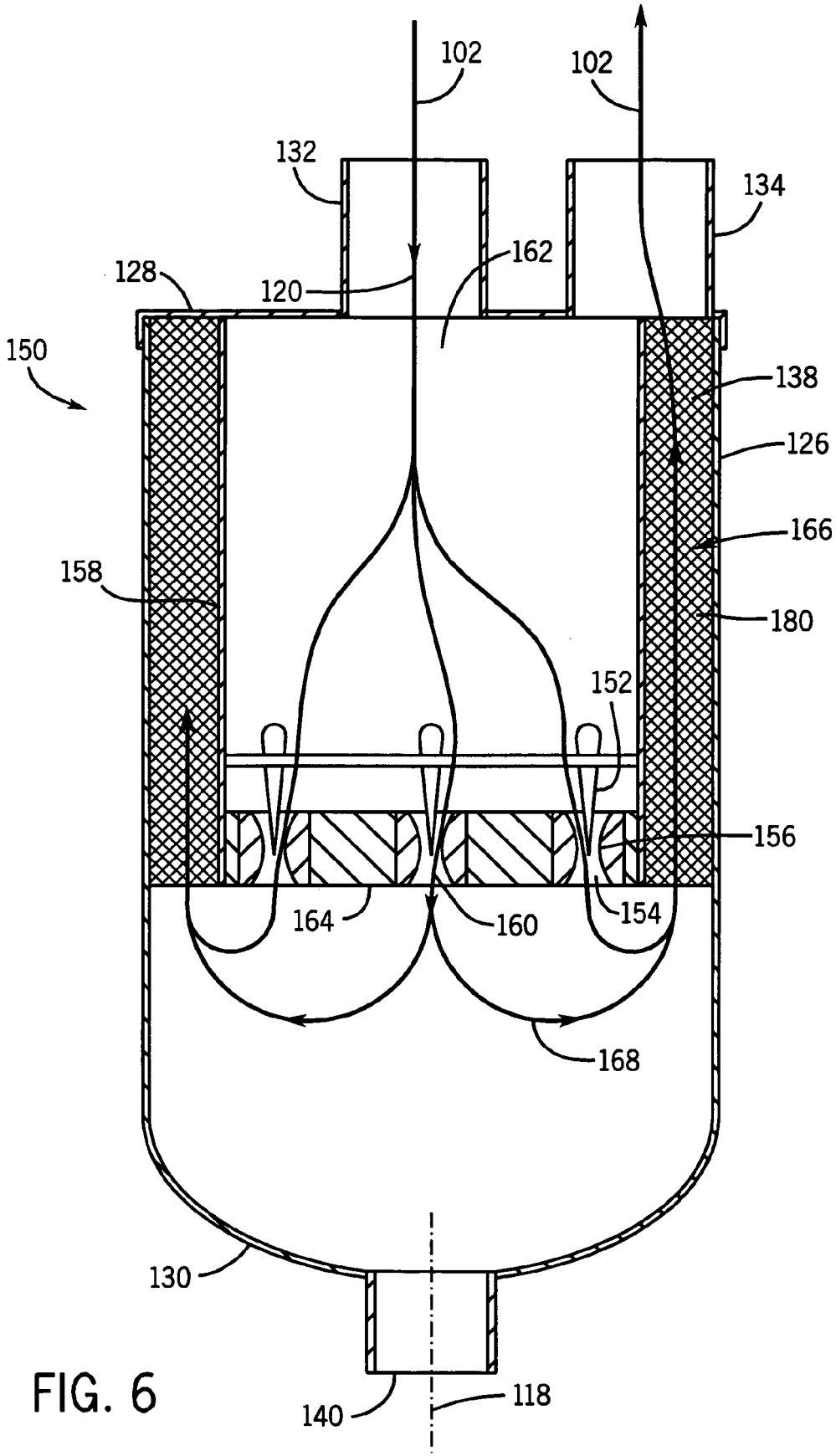
FIG. 6 is a view like FIG. 5 and shows another embodiment.

FIG. 6 shows another embodiment and uses like reference numerals from above where appropriate to facilitate understanding. Electrically conductive collection media 180 is provided in the noted second zone 166 between drum 158 and outer ground plane 126. The electrically conductive collection media is preferably wire mesh, metal honeycomb, or the like. Such media is in contact with outer ground plane 126 and hence is at ground potential. As the charged particles enter collection region 166 as shown at arrows 168, the particles are collected on media 180. Diffusion is the primary mechanism for this collection. Drum 158 is an electrical insulator.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations described herein may be used alone or in combination with other configurations. It is to be expected that various equivalents, alternatives and modifications are possible within the scope of the appended claims.

What is claimed is:

1. An electrostatic precipitator for cleaning a gas flowing therethrough from upstream to downstream along a gas flow path comprising a first zone comprising a corona discharge ionization zone creating ions which in turn charge particles in said gas, and a second zone comprising a collection zone collecting said charged particles, said second zone being downstream of said first zone, an anti-collector guide in said first zone preventing collection of said charged particles thereat and instead directing said charged particles to flow to said second zone downstream thereof for collection at said second zone, a corona discharge electrode at said first zone creating an electric field providing said corona discharge ionization, and wherein said anti-collector guide comprises a field-shield in said first zone and shielding said charged particles from said electric field to prevent collection of said charged particles in said first zone, wherein said field-shield divides said first zone into first and second subzones, said first subzone being on one side of said field-shield and guiding said charged particles to said second zone, said second subzone being on the opposite side of said field-shield and between said corona discharge electrode and said field-shield and providing said ionization, said field-shield comprises a perforated tube extending axially along an axis and guiding incoming gas from an inlet axial tube end to an axially distally opposite outlet axial tube end, said corona discharge electrode comprises an axially extending hollow drum surrounding said tube, said first subzone being inside said tube, said second subzone being outside said tube and between said tube and said drum, and wherein ions created by ionization in said second subzone pass through perforations in said tube to create said charged particles in said first subzone inside said tube, said charged particles being shielded by said tube from the electric field in said second subzone outside said tube created by said corona discharge electrode.

2. The electrostatic precipitator according to claim 1 wherein said tube is at ground potential.

3. The electrostatic precipitator according to claim 1 comprising an outer ground plane surrounding said drum, said second zone being outside of and surrounding said drum and being between said drum and said outer ground plane.

4. The electrostatic precipitator according to claim 3 wherein said outer ground plane comprises a canister extending axially along said axis between first and second axial ends, said first axial end having both a gas inlet and a cleaned gas outlet, said gas inlet being at said inlet axial tube end, said cleaned gas outlet receiving cleaned gas from second zone, wherein gas flows from said gas inlet in a first axial direction through said first zone through the inside of said tube to said outlet axial tube end, then flows radially outwardly to said second zone, then flows in a second opposite axial direction through said second zone to said cleaned gas outlet.

5. An electrostatic precipitator for cleaning a gas flowing therethrough from upstream to downstream along a gas flow path comprising a first zone comprising a corona discharge ionization zone creating ions which in turn charge particles in said gas, and a second zone comprising a collection zone collecting said charged particles, said second zone being downstream of said first zone, an anti-collector guide in said first zone preventing collection of said charged particles thereat and instead directing said charged particles to flow to said second zone downstream thereof for collection at said second zone, a corona discharge electrode at said first zone creating an electric field providing said corona discharge ionization, and wherein said anti-collector guide comprises one or more venturis in said first zone accelerating said charged particles to prevent collection thereof in said first zone, wherein said corona discharge electrode comprises one or more corona discharge tips each disposed in one of said venturis and providing said ionization in an ionization zone in the respective said venturi, and comprising a hollow drum extending axially along an axis and defining and surrounding said first zone therein, said one or more venturis accelerating said charged particles axially therethrough, and an outer ground plane surrounding said drum, said second zone being outside of and surrounding said drum and being between said drum and said outer ground plane.

6. The electrostatic precipitator according to claim 5 wherein said outer ground plane comprises a canister extending axially along said axis between first and second axial ends, said first axial end having both a gas inlet and a cleaned gas outlet, wherein gas flows from said gas inlet in a first axial direction through said first zone through said one or more venturis through the inside of said drum, then flows radially outwardly to said second zone, then flows in a second opposite axial direction through said second zone to said cleaned gas outlet.

7. The electrostatic precipitator according to claim 5 comprising electrically conductive collection media in said second zone between said drum and said outer ground plane.

8. The electrostatic precipitator according to claim 7 wherein said electrically conductive collection media is selected from the group consisting of wire mesh and metal honeycomb.

9. The electrostatic precipitator according to claim 7 wherein said drum is an electrical insulator.

* * * * *